United States Patent [19]

Koch et al.

[11] Patent Number: 4,942,917

[45] Date of Patent: Jul. 24, 1990

[54] EXPENDABLE CASTING CORE FOR A CYLINDER

[75] Inventors: Byron W. Koch; Robert I. Badenhope, both of Toledo, Ohio

[73] Assignee: Farley, Inc., Chicago, Ill.

[21] Appl. No.: 378,317

[22] Filed: Jul. 11, 1989

[51] Int. Cl.[5] ..... B22C 9/10; B22C 9/24

[52] U.S. Cl. ..... 164/369

[58] Field of Search ..... 164/369, 370, 340, 137

[56] References Cited

U.S. PATENT DOCUMENTS

| | | | |
|---|---|---|---|
| 455,143 | 6/1891 | Adams | 164/137 |
| 1,758,488 | 5/1930 | Weil | 164/340 X |
| 2,783,510 | 3/1957 | Dolza et al. . | |
| 3,264,693 | 8/1966 | Flitz . | |
| 3,756,309 | 9/1973 | Nishiyama et al. | 164/369 |

FOREIGN PATENT DOCUMENTS

| | | | |
|---|---|---|---|
| 62-57755 | 3/1987 | Japan . | |
| 62-110856 | 5/1987 | Japan | 164/369 |
| 64-83336 | 3/1989 | Japan | 164/369 |

*Primary Examiner*—Richard K. Seidel
*Assistant Examiner*—J. Reed Batten, Jr.
*Attorney, Agent, or Firm*—Hugh Adam Kirk

[57] ABSTRACT

The hollow frusto-conical expendable core is used for forming a jacket around a cylinder in a casting die for forming a cylinder block. The core has a printout portion comprising an inwardly extending annular flange connected to the narrower end of the frusto-cone by circumferentially spaced axially extending legs. The core may comprise a plurality of frusto-cones for a corresponding plurality of cylinders in an engine block with their axes parallel in a common plane with the annular flanges of their printout portions integrally connected for strengthening the multi-cylinder jacket core.

8 Claims, 2 Drawing Sheets

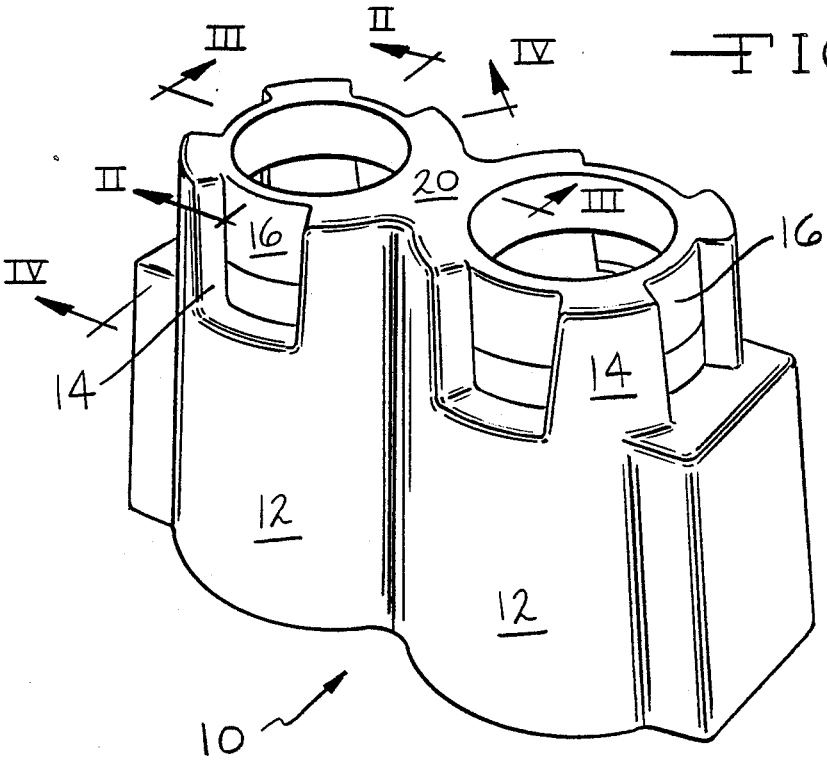
FIG. I
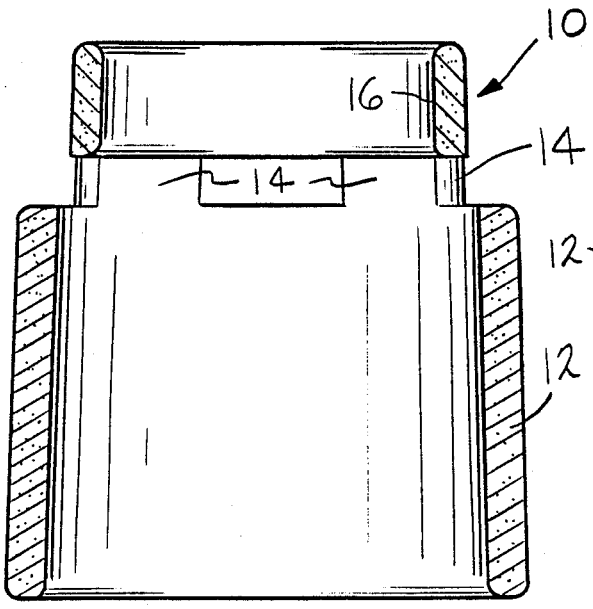
FIG. II
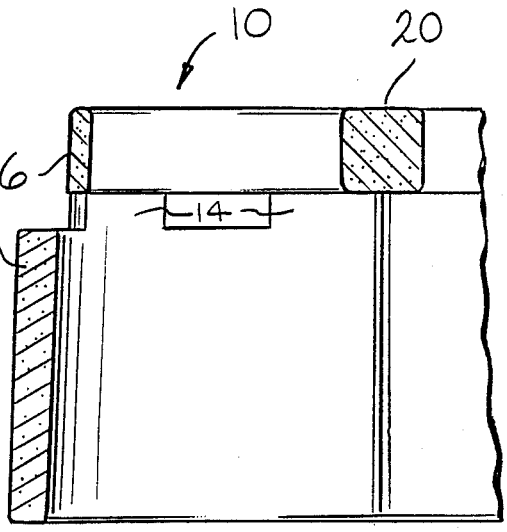
FIG. III

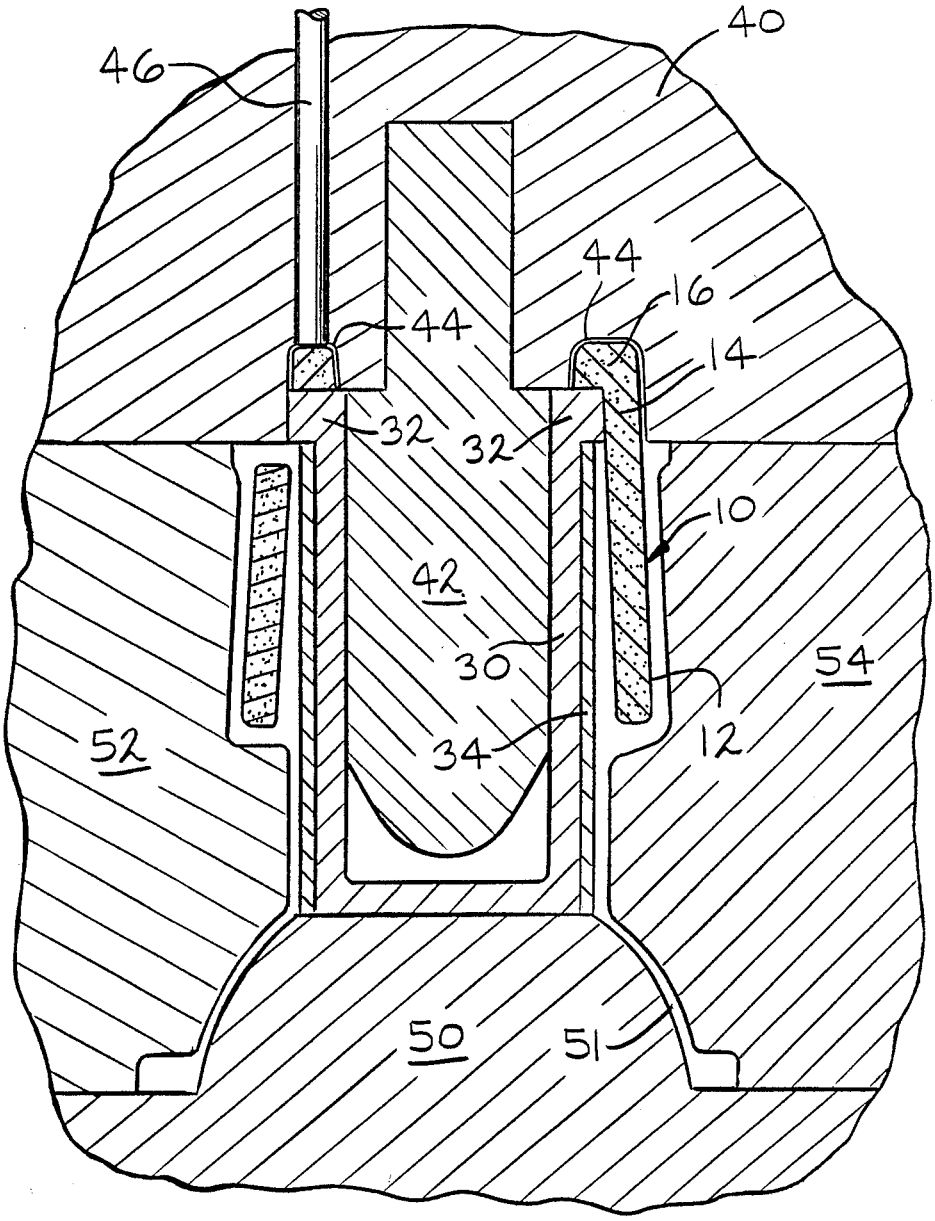
FIG. IV

EXPENDABLE CASTING CORE FOR A CYLINDER

RELATED APPLICATION

This application is related to applicants' copending U.S. patent application Ser. No. 378,315 filed July 11, 1989 directed to mandrels for supporting and positioning the expendable cores in this application in a casting die.

BACKGROUND OF THE INVENTION

Previously cores for forming jackets for coupling liquids around cylinders such as in the blocks of internal combustion engines had printout portions in their cylindrical sides and not at the ends thereof. Furthermore, if there was any taper at all in the surfaces of the core, it was converging from the center side printout in both axial directions. Also there was no connection between the sides of the cores between cylinders of a plural cylinder core, so that the only connection between opposite sides of the plural cylinder core was at the ends of the core.

SUMMARY OF THE INVENTION

The expendable core for the water jacket around each cylinder to be formed in a casting die is slightly frusto-conical rather than cylindrical in shape with the narrower end having a printout portion with an annular inwardly extending flange connected by circumferentially spaced legs to the narrower end of each hollow frusto-conical portion of the core. This annular flange provides a means for supporting and holding the core in the die, as well as a surface for referencing locating pins for better positioning the core in the casting die. Such an expendable core for the jacket around a plurality of axially parallel cylinders in the same plane have their adjacent annular printout portions of each cylinder integrally joined to increase the rigidity of the core.

OBJECTS AND ADVANTAGES

It is an object to produce an efficient, effective, economical, strong expendable core for the undercut jacket around the cylinder in a block formed in a casting machine, which core can withstand heat and pressure, but yet has good shake-out properties after the block has solidified around the core and in the die.

Another object is to produce a tapered core wherein the hottest end of the cylinder has the thinnest wall of the jacket to effect better cooling.

Another object is to produce such a core which is substantially rigid when made for a plurality of parallel cylinders by connecting together their adjacent printout portions.

A further object is to provide a core which has in its printout portion a flange for engagement with a mandrel for positively locating the core in a die.

Still another object is to provide such a core in which its printout portion has a surface for referencing locating pins for better positioning this core in a die.

BRIEF DESCRIPTION OF THE DRAWINGS

The above mentioned and other features, objects and advantages and a manner of attaining them are described more specifically below by reference to an embodiment of this invention shown in the accompanying drawings wherein:

FIG. I is a perspective view of an expendable core for the water jacket around a pair of cylinders in an engine block;

FIG. II is an enlarged sectional view taken along line II—II of FIG. I showing the printout portion with its inwardly extending annular flange supported by spaced legs above the narrower end of the frusto-conical sides of the core;

FIG. III is a sectional view taken along line III—III of FIG. I showing the connection between adjacent annular flanges of the printout portions of adjacent cylinder jackets in the core, with part of one cylinder core broken away; and FIG. IV is a sectional view along lines IV—IV of the core in FIG. I with this core in position in a die for forming a jacket in a cylinder block, with the different parts of the die away from the core being broken away.

DETAILED DESCRIPTION OF PREFERRED EMBODIMENT

Referring to FIG. I, there is shown in perspective an expendable core 10 for the water jacket in a two-cylinder engine block. The water jacket core comprises the hollow frusto-cones 12, one for each cylinder, and at the narrower end of each frusto-cone 12 is provided a printout portion comprising legs 14 and an inwardly extending annular ring 16 supported by said legs. Adjacent annular flanges 16 of the printout portions may be integrally joined as shown in FIGS. I and III by a bridge 20 to add strength to the core, in that there is no jacket between adjacent cylinders and therefore no core between them. If a one-cylinder jacket core is needed, then half of the core or one frusto-cone is formed for the core, and if a core for an engine block of more than two cylinders is needed, the frusto-conical core is extended by joining adjacent printout portions together, such as by the bridge 20 between the two printout portions shown in FIG. I.

Referring now to FIG. IV there is shown a core 10 sectioned along line IV—IV in FIG. I in a die. The annular flange 16 on the printout portion is held by an outwardly extending flange 32 of a mandrel 30, which mandrel may also support a cylinder liner 34 to be cast in the cylinder of the cylinder block. This mandrel 30 is placed on a dowel 42 of an ejector die 40 which has printout cavities 44 which may be larger than the printout portions 14 and 16 of the core, so that the core can float and not break when the die is closed. However, the gap between the printout cavity and the printout portion of the core preferably has at least one locating pin 46 for bridging part of this gap to better position the core 10 in the die. Herein the mandrel 30 is clamped between the ejector die 40 and the cover or fixed die 50, which die 50 also forms part of the crankcase of the engine block formed in the space 51. Between these die parts 40 and 50 there are shown a pair of opposite slides 52 and 54 for forming the opposite longer sides of the cylinders.

It should be understood that the shape of the frusto-cone and cylinders mentioned in this application do not necessarily have to be circular but may be non-circular in cross-section, such as ovals, polygons, and so forth.

Furthermore, when the design of the block permits sufficient space, the frusto-cone 12 of the water jacket can extend between the cylinders, providing additional strength to the core and additional cooling to the engine cylinder.

The expendable core is preferably made of sand bound together by an organic resin which decomposes after the hot metal injected into the die around the core has solidified.

While there is described above the principles of this invention in connection with specific apparatus, it is to be clearly understood that this description is made only by way of example and not as a limitation to the scope of this invention.

What is claimed is:

1. An expendable sand core for a jacket around a cylinder in a cylinder block, said core comprising a hollow frusto-core with a printout portion at its narrower end for locating said core in a die for casting said cylinder block.

2. A core according to claim 1 wherein said printout portion includes an inwardly extending annular flange spaced by circumferentially spaced legs from and around said narrower end of said frusto-cone.

3. A core according to claim 2 wherein said die includes mandrel means for engagement with said flanged printout portion for supporting said core in said die.

4. A core according to claim 1 wherein said printout portion of said core provides a surface for locating pins for positioning said core in said die.

5. An expendable sand core for a jacket around a plurality of cylinders in a die cast engine block comprising a plurality of hollow frusto-cones, one for each cylinder, each frusto-cone having a printout portion at its narrower end with adjacent printout portions being connected together.

6. A core according to claim 5 wherein said cylinders are aligned with their axes parallel and in the same plane.

7. A core according to claim 5 wherein each said printout portion includes an inwardly extending annular flange, said flange being connected by legs to said narrower end of its frusto-cone.

8. A core according to claim 5 wherein said printout portion of said core provides surfaces for locating pins for positioning said core in said die.

* * * * *

UNITED STATES PATENT AND TRADEMARK OFFICE

CERTIFICATE OF CORRECTION

PATENT NO. : 4,942,917

DATED : July 24, 1990

INVENTOR(S) : Byron W. KOCH and Robert I. BADENHOPE

It is certified that error appears in the above-identified patent and that said Letters Patent is hereby corrected as shown below:

Column 1, line 12, change "coupling" to - - cooling - - .

Column 3, line 16, change "core" to - - cone - - .

Signed and Sealed this

Twenty-sixth Day of November, 1991

*Attest:*

HARRY F. MANBECK, JR.

*Attesting Officer*

*Commissioner of Patents and Trademarks*